US006005343A

United States Patent [19]

Rakhimov et al.

[11] Patent Number: 6,005,343

[45] Date of Patent: Dec. 21, 1999

[54] HIGH INTENSITY LAMP

[76] Inventors: Alexander Tursunovich Rakhimov, Rostovskaya naberejnaya 1 - 95, 119121, Moscow; Evgeniy Anatolievich Muratov, University prospect 5 - 321, 117296, Moscow; Nikolay Vladislavovich Suetin, prospect Lenina 20A - 36, 144005, Elektrostal, all of Russian Federation

[21] Appl. No.: 08/706,077

[22] Filed: Aug. 30, 1996

[51] Int. Cl.[6] ..... H01J 01/62; H01J 63/04; H01J 17/04; H01J 61/04

[52] U.S. Cl. ..... 313/493; 313/484; 313/485; 313/491; 313/631; 313/632; 313/633; 313/634; 313/635

[58] Field of Search ..... 313/631–32, 633, 313/634–35, 573–74, 575, 420, 491–93, 309, 336, 351, 495, 484–85

[56] References Cited

U.S. PATENT DOCUMENTS

| | | | |
|---|---|---|---|
| 4,818,914 | 4/1989 | Brodie | 315/169.3 |
| 5,050,946 | 9/1991 | Hathaway et al. | 385/33 |
| 5,146,354 | 9/1992 | Plesinger | 359/49 |
| 5,248,917 | 9/1993 | Hamagishi et al. | 315/169.1 |
| 5,495,143 | 2/1996 | Lengyel et al. | 313/574 |
| 5,600,200 | 2/1997 | Kumar et al. | 313/495 |
| 5,686,789 | 11/1997 | Schoenbach et al. | 313/491 |

OTHER PUBLICATIONS

D. Hong and M. Aslam, "Design and Fabrication of Diamond Field Emitter Structures," Dept. of Electrical Engineering, Michigan State University.

A. Lamouri, et al, "Electron Emission Observations from As–Grown and Vacuum–Coated Chemical Vapor Deposited Diamond.".

W.B. Choi, et al, "Field Emission Characteristics of Diamond Coated Molybdenum Field Emitters," Dept. of Materials Science and Engineering, North Carolina State University.

"The Theoretical and Experimental Study of Large–Aperture Low Energy E–Beam Source for Semiconductor Processing," *J. Vac. Sci. and Tech. A*, 1992, n. 4, pp. 1080–1091.

A.I. Akinwande, "Thin–Film–Edge Emitter Vacuum Microelectronics Devices for Lamp/Backlight Applications.".

N. Chubun, "Vacuum Fluorescent Light Source with Carbon Fibres Field Emission Cathode," institute of Theoretical and Experimental Physics.

A.L. Suvorov, et al., "Vacuum Luminescent Light Source with Carbon Fibres Field Emission Cathode," Institute of Theoretical and Experimental Physics.

*Primary Examiner*—Nimeshkumar D. Patel
*Assistant Examiner*—Mack Haynes
*Attorney, Agent, or Firm*—Stein, Schifino & Van Der Wall

[57] ABSTRACT

A high intensity lamp is provided based on an open discharge between a cathode grid anode and a collector. A phosphor layer on the collector is excited by an electron beam to produce light or ultraviolet radiation to produce light.

17 Claims, 4 Drawing Sheets

HIGH INTENSITY LAMP

TECHNICAL FIELD

This invention relates to lamps. More particularly, a high intensity lamp employing an electron beam from a glow discharge impinging upon a phosphor is provided.

BACKGROUND INFORMATION

Backlighting is generally necessary in all Liquid Crystal Displays (LCDs). Such displays may be used in televisions, lap-top computers, and various types of aircraft and automotive displays. The backlight in these systems is normally provided from a miniature fluorescent lamp. In many of these applications the backlight is the largest single consumer of power in the display system. There is clearly a need for high efficiency, versatile lamps for applications with LCDs.

The efficiency of electric lamps using filaments has not increased significantly for many years. Fluorescent discharge lamps are more efficient, but have other limitations which have been difficult to remove, such as the potential for environmental pollution from mercury in the lamps.

Cathodoluminescent lamps have been known for several years. They originally employed thermionic cathodes. U.S. Pat. No. 4,818,914 provided an improvement in cathodoluminescent lamps based on a field emission cathode. A layer of phosphor on an anode is located inside an envelope along with the field emission cathode, which is placed opposite the phosphor layer. A voltage source, either DC or AC, is connected across the cathode and accelerator electrodes to cause field emission of electrons from tips of needle-like members. A higher voltage is connected across the cathode and an anode for attracting electrons to the phosphor layer and exciting the phosphor to luminescence.

In aviation and automobile displays, particularly, there is a need for a light source that can be dimmed and that does not fail catastrophically. For other types of displays and light sources, such as projectors, a high brightness is needed. In some applications it is important to have the capability to scale-up the size of the source to provide high total light output. In all light sources, there is a need for a simple and efficient source and a source that will not cause environmental pollution.

SUMMARY OF THE INVENTION

A high intensity lamp is provided. The lamp includes a cathode, a grid anode and a collector, which is transparent and coated with phosphor. Electrons pass through the grid electrode into the drift space, or the space between the grid and the collector. The collector is covered with a phosphor. The electrons can excite and ionize a gas in the drift space while losing only a small fraction of their energy. Positive ions and photons formed in the drift space by electrons can penetrate through the grid electrode back onto the cathode, where they give rise to increased secondary electron emission from the cathode. Thus, the density of the plasma in the discharge region builds to a high steady-state value. The phosphor screen is activated by the beam of electrons passing through the grid and through the drift space.

Electrical power may be applied to the lamp either by direct current or by voltage pulses. In one embodiment, high voltage pulses are used, allowing the employment of more efficient phosphors while avoiding excessive power consumption. In another embodiment, the electron beam from the open discharge is used to generate ultraviolet radiation from the gas in the lamp and this radiation is transformed into visible light by photophosphors. In yet another embodiment, the cathode is also made of a grid and positive ions passing through the cathode grid produce a double layer, which may generate an electron beam (e-beam). This e-beam may be used to activate a phosphor layer on an opposite side of the cathode.

Gases in the lamp are normally inert gases at a pressure in the range from about 0.1 Torr to about 100 Torr.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWING

For a more complete understanding of the present invention, and the advantages thereof, reference is now made to the following descriptions taken in conjunction with the accompanying drawings, in which.

DETAILED DESCRIPTION

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail.

Figure 1:
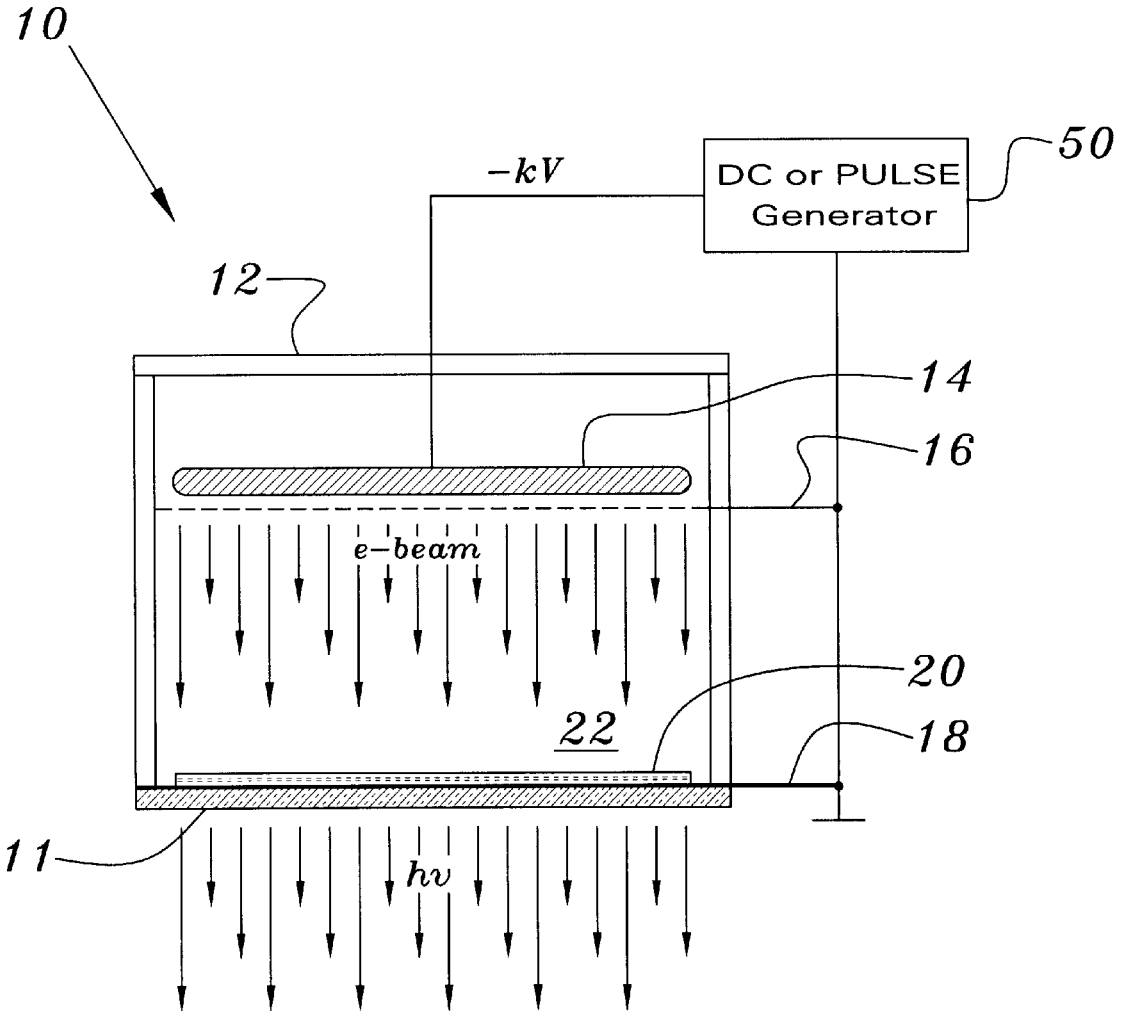
FIG. 1 is a sketch of the apparatus of this invention.

Refer now to the drawings wherein depicted elements are not necessarily shown to scale Referring to FIG. 1, a cross-sectional view of lamp 10 according to the present invention is shown. Lamp 10 includes envelope 12, which is an insulator and at least one side 11 of the envelope is transparent. Suitable material for the envelope is glass. Envelope 12 is designed to be evacuated to a high vacuum. Cathode 14 is a flat conductor, such as stainless steel or other metal, which may be polished. Cathode 14 is not easily subjected to sputtering effects, as it will be subjected to bombardment by positive ions as described below. In other words, cathode 14 may be made of a material that does not easily deteriorate due to sputtering as a result of such a bombardment of positive ions. At a selected distance from cathode 14 is mesh or grid 16. The distance between cathode 14 and grid 16 may be from about 0.5 mm to about 2 mm. Grid 16 may also be made from a low sputtering material, such as stainless steel, molybdenum, tungsten or tantalum. Grid 16 may have a transparency of about 80%, meaning that only 20% of the cross-sectional area of the grid is solid. Transparency may be in the range from about 50% to about 90%, but could be designed outside of these parameters. Grid 16 may be formed from wires or may be formed from plates through which holes are formed. If wire screen is used, the cell size may be in the range from about 200 to 300 micrometers and the wire size is about 20–30 micrometers. On an opposite side of grid 16 from cathode 14, and parallel to cathode 14 and grid 16 is a wall of envelope 12. This wall will be transparent and have transparent conductive layer 18, which may be a layer of indium tin oxide (ITO), and phosphor layer 20 thereon. Methods of forming layers of ITO are well known in the art. The phosphor in phosphor layer 20 may be selected from phosphors known in the art and deposited by known methods. The phosphor may be selected based upon the operating conditions expected in the lamp. If the lamp is to be operated by DC voltage, a lower voltage will normally be used and a phosphor will be selected for such use. If the lamp is to be operated by a pulsed voltage source, higher voltage phosphors will be selected. Phosphor layer 20 may be located at a distance from about 1 cm to about 3 cm from grid 16.

Envelope 12 is evacuated and is filled to a selected pressure with working gas 22, which may be an inert gas such as helium, neon, argon, xenon or their mixtures (or, equivalent gases). The pressure of such gas is normally in the range from about 0.1 Torr to about 100 Torr.

Electrical power is applied to lamp 10 from power source 50. If power source 50 is a continuous or DC supply, voltage may be in the range from about 500 volts to about 10 kilovolts. If power source 50 is a pulse generator, the pulsed voltage may be in the range from about 10 kilovolts to about 20 kilovolts. The pulse length may vary, but commonly a pulse having a width of about 10 microseconds to about 20 microseconds may be applied at a frequency from about 10 Hz to about 20 kHz. The duty cycle for pulsed power is normally selected to be from about $10^{-2}$ to about 50 percent. Dimming of the light source may be by control of the frequency of the pulses, although control may be achieved by voltage or, over a limited range, by pulse width.

Figure 2:
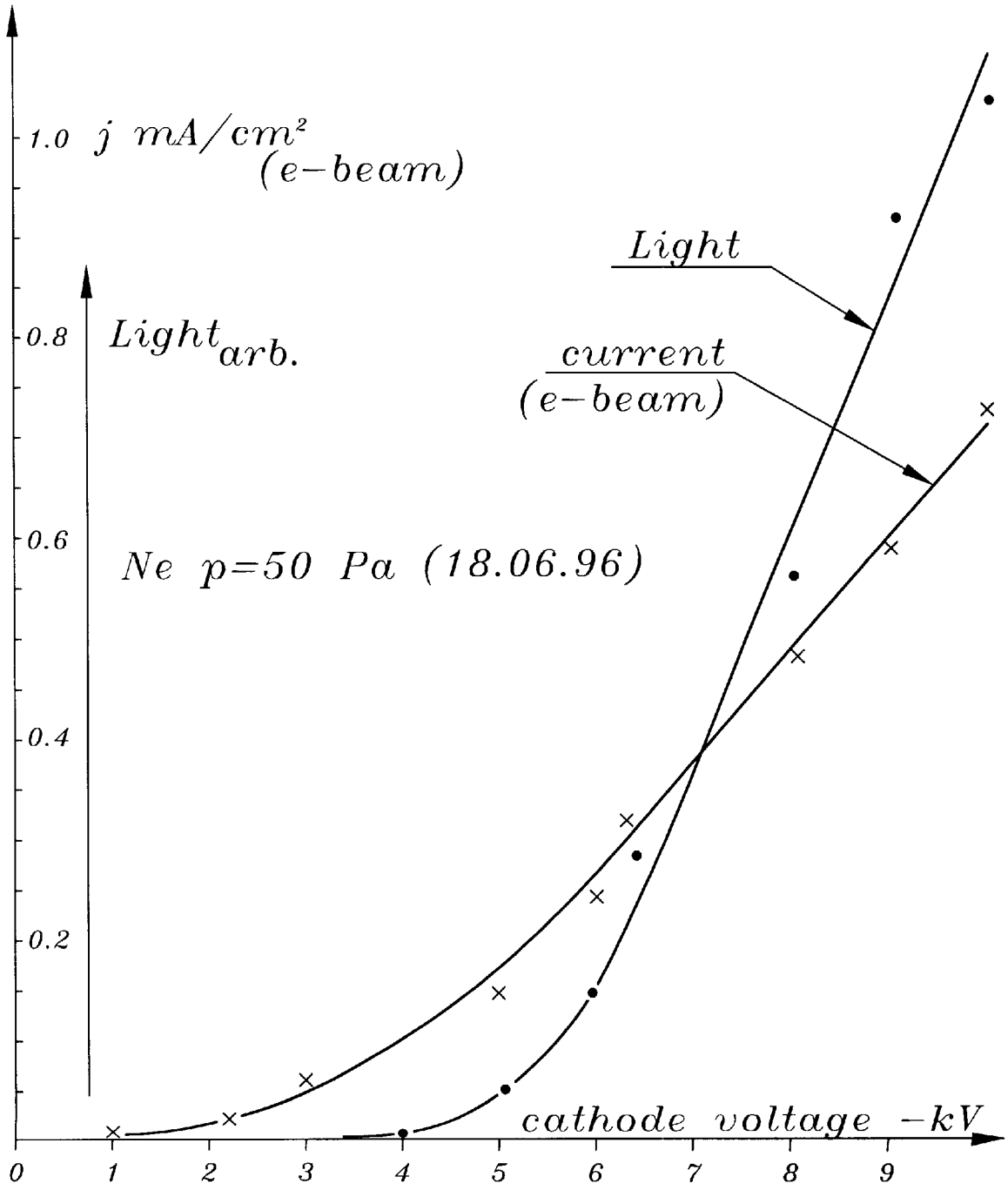
FIG. 2 is a graph of electrical current and relative light output as a function of cathode voltage for the lamp of this invention when the gas in the lamp is neon at a pressure of 0.5 Torr.

The electrical power consumed by a lamp under optimum operating conditions is dependent upon the working gas in the lamp, the pressure of that gas and the lamp configuration. FIG. 2 shows the current collected on the grid and the ITO electrode, such as electrodes 16 and 18 of FIG. 1, for a lamp containing neon at a pressure of 0.5 Torr. The lamp upon which data were obtained in FIG. 2 had a cathode made of stainless steel which was separated from a grid electrode by 1 mm and from the ITO layer by 2 cm. DC voltage was applied to the cathode and current through the grid and ITO layer, which were at ground, was measured at increasing values of voltage. Light emission from the phosphor layer was measured outside the envelope by a RFS Mod. 550 Eletr. Optic photometer. Light emission was first observed at a cathode voltage of around 5 kilovolts; light emission increased more rapidly above this value of voltage than electrical current increased. At a voltage of 8 kilovolts, current was about 2 milliamp/$cm^2$. Therefore, electrical power consumption was about 16 watts and light intensity was measured to be approximately 2000 ft-lamberts.

Figure 3:
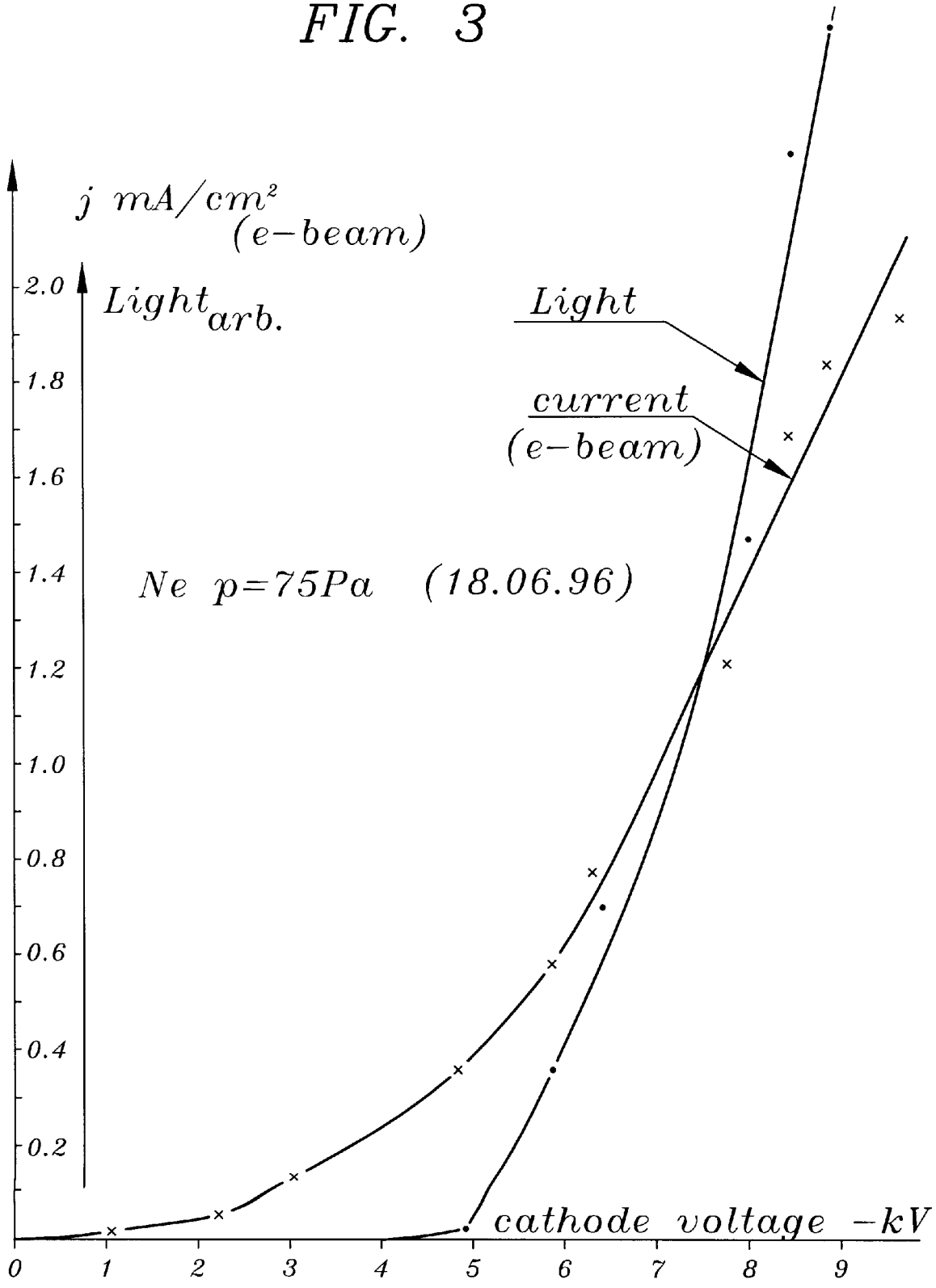
FIG. 3 is a graph of electrical current and relative light output as a function of cathode voltage from the lamp of this invention when the gas in the lamp is neon at a pressure of 0.4 Torr.

Similar measurements were made for a lamp having the same configuration (FIG. 1), but filled with neon at pressure 0.4 Torr. FIG. 3 shows the results of measurements of electrical current and light output.

The phosphor in the lamps shown in FIGS. 1 and 2 was YAG, which produced a green color light. It is well known that light intensity produced by an electron beam is dependent on the properties of the phosphor, the thickness of the phosphor and other properties of a phosphor layer well known to those in the art of phosphors and phosphor deposition. Any phosphor known in the art which can be activated by an electron beam may be used in the lamp of this invention. It is not intended that the light intensity of measurements reported herein be representative of the light output which can be obtained employing the apparatus and method of this invention with different phosphors. More efficient phosphors will produce higher light output at the same value of electrical power input.

Electron beam sources based on an open discharge have been tested as an etching system for use in semiconductor processing. A. S. Kovalev, Yu. A. Mankelevich, E. A. Muratov, A. T. Rakhimov, N. V. Suetin, "The Theoretical and Experimental Study of Large-Aperture Low Energy E-Beam Source for Semiconductor Processing", *J. Vac. Sci. and Tech. A*, 1992, n. 4, pp. 1080–1091, which is hereby incorporated herein by reference. A numerical model of the plasma processes in such an electron beam has been developed. Although not wishing to be bound by the model of the processes occurring in the open discharge or glow discharge which is employed in this invention, the source of the electron beam is as follows: a voltage gradient sufficient to begin to draw electrons from the cathode is developed between the mesh anode and the cathode. Most of these electrons pass through the high transparency grid into the drift space, or the region between the grid and the collector. Some of the electrons entering the drift space excite and ionize some of the atoms of the working gas in the drift space, while expending only a small part of their energy in the low pressure working gas. The positive ions produced by the electrons then migrate back through the transparent grid and bombard the cathode, causing increased secondary emission of electrons. The current density of electrons thus increases and the plasma density increases to a steady-state value. Under typical operating conditions, about 80% of the discharge current is carried by the beam of penetrating electrons, which impinge upon the phosphor layer with an energy corresponding to the applied voltage.

The apparatus comprising a cathode, grid and collector, where secondary emission of electrons from the cathode is effected, is also referred to herein as a reflex triode.

The open discharge volume of the lamp may be increased in cross-sectional area to any selected value to produce a proportionally higher total amount of light. The thickness of the drift volume will be great enough to allow a sufficient current of positive ions to be to formed. If the drift volume is not sufficiently thick, the electrical current and light output from the lamp will be reduced.

Figure 4:
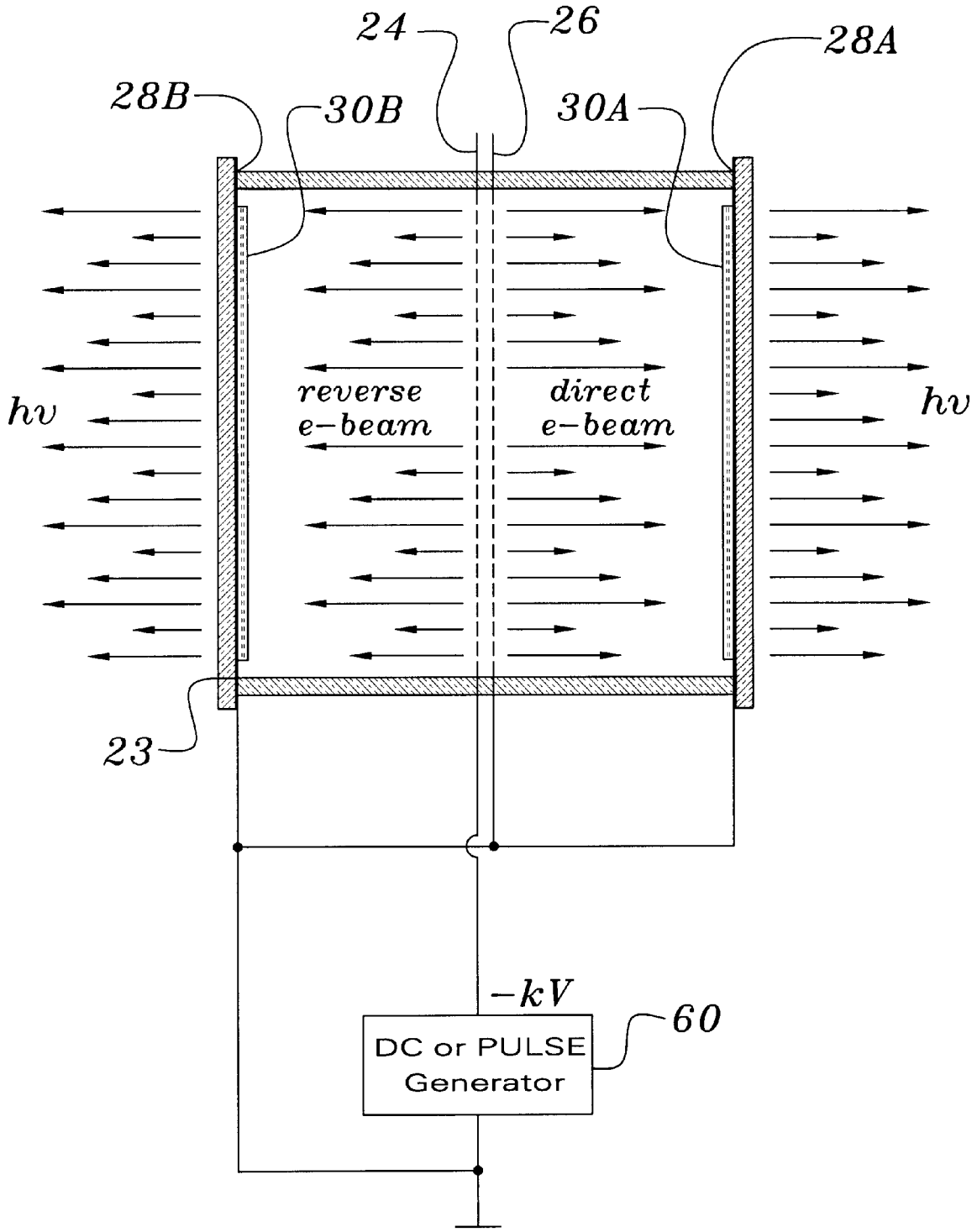
FIG. 4 shows an embodiment of the lamp wherein the cathode is a mesh and the anode is a mesh and an electron beam is directed toward phosphor layers on opposite ends of the lamp enclosure.

Referring to FIG. 4, an alternative embodiment of the lamp of this invention. a "double lamp" having two electron beams in opposite directions, to the electrodes 28A and 28B is shown. In this embodiment, cathode 24 is also made from mesh having high transparency as defined above. It may be made from a metal of the same composition as the cathode or mesh described above. Anode grid 26 is also made of mesh as described above. In this configuration, positive ions passing through cathode grid 24 produce double layer, which may generate an electron beam. This e-beam may be used to activate phosphor layer 30A on an opposite side of the cathode 24. In this region, positive ions are formed which then pass back through anode mesh 26 and impinge upon cathode mesh 24, producing secondary electrons which are accelerated toward anode 28B, in a reverse direction electron beam. In this embodiment, two phosphor screens, 30A and 30B, on each side of a grid cathode and a grid anode, are activated. Power supply 60 of such lamp may be direct current or a pulsed generator, as described above.

In another embodiment of the apparatus and method of this invention, the working gas used in the lamp is selected to produce ultraviolet radiation from the open discharge region. Such working gas is He, Ne, Ar, Xe and their mixtures at a pressure range from about 0.1 Torr to about 1000 Torr. The phosphor is selected to be sensitive to ultraviolet radiation. The phosphor is used to coat the envelope of such lamp, and may be used along with or instead of the phosphor on the collector of the lamp.

Although the present invention and its advantages have been described in detail, it should be understood that various changes, substitutions and alterations can be made herein without departing from the spirit and scope of the invention as defined by the appended claims.

What is claimed is:

1. A lamp comprising:

an envelope;

a flat cathode;

a grid anode disposed at a selected distance from the cathode;

a transparent electrode deposited on a transparent wall of the envelope and having a phosphor layer thereon, the electrode being disposed at a selected distance from the grid anode and approximately parallel thereto;

a working gas at a selected pressure in the envelope; and a voltage gradient sufficient to draw electrons from the cathode to the anode, said electrons exciting and ionizing some of the atoms of the working gas in a space between the grid anode and the transparent electrode thereby creating positive ions that bombard said cathode creating a secondary emission of electrons from said cathode.

2. The lamp as recited in claim 1, wherein the working gas is selected from the group of inert gases.

3. A lamp comprising:

an envelope;

a flat cathode;

a grid anode disposed at a selected distance from the cathode;

a transparent electrode deposited on a transparent wall of the envelope and having a first phosphor layer thereon, the electrode being disposed at a selected distance from the grid anode and approximately parallel thereto;

a working gas at a selected pressure in the envelope; and said cathode being made from a transparent grid and further comprising a second phosphor and electrode layer, the second layer being disposed on opposite sides of the grid and cathode from the first phosphor layer.

4. An apparatus comprising:

a reflex triode having a cathode, a grid electrode, and an anode;

a gas disposed within said reflex triode;

said cathode being made from a transparent grid and further comprising a phosphor and electrode layer.

5. The apparatus as recited in claim 4, wherein said grid electrode is positioned between said cathode and said anode.

6. The apparatus as recited in claim 4, wherein secondary emission of electrons from said cathode is produced from a bombardment of positive ions produced by excitation of said gas by electrons extracted from said cathode wherein said positive ions bombard said phosphor to produce light.

7. The apparatus as recited in claim 5, wherein secondary emission of electrons from said cathode is produced from a bombardment of positive ions produced by excitation of said gas by electrons extracted from said cathode by said grid, wherein said grid has a selected transparency to permit passage of said electrons and said positive ions.

8. The apparatus as recited in claim 4, further comprising:

an envelope for encompassing said gas; and a second phosphor, wherein electrons emitted by said reflex triode bombard said second phosphor to produce light.

9. A method comprising the steps of:

providing a first electrode;

a gas disposed around said first electrode;

said first electrode being made from a transparent grid;

said first electrode having a phosphor and electrode layer;

extracting electrons from said first electrode, said electrons ionize said gas to produce positive ions; and migrating said positive ions towards said first electrode, causing a secondary emission of electrons from said first electrode and an emission of photons.

10. The method as recited in claim 9, further comprising the step of:

providing a second phosphor; and migrating said extracted electrons and said electrons caused by said secondary emission to said second phosphor to thereby cause emission of photons.

11. The method as recited in claim 10, wherein said extracting step is caused by a grid electrode having a transparency to permit passage of said extracted electrons, said positive ions, and said electrons caused by said secondary emission.

12. The method as recited in claim 11, wherein said extracting and said migrating steps are caused by an electric field set up between said first electrode and said grid electrode.

13. A lamp comprising:

a cathode;

a grid electrode positioned near said cathode;

an anode, whereby said grid electrode is positioned between said cathode and said anode;

a gas positioned between said cathode and said anode; and a first phosphor positioned to receive electrons emitted from said cathode, wherein said electrons are emitted by said cathode as a result of (1) extraction caused by a voltage gradient between said cathode and said grid electrode, and (2) secondary emission of electrons from said cathode caused by bombardment of positive ions produced by excitation of said gas by said electrons extracted from said cathode by said voltage gradient;

said cathode being made from a transparent grid and further comprising a second phosphor and electrode layer, the second phosphor being disposed on opposite sides of the grid and cathode from the first phosphor.

14. The lamp as recited in claim 13, wherein said gas is positioned between said cathode and said anode by an envelope, wherein said envelope has a transparent side to allow passage of photons emitted by said first phosphor and said second phosphor.

15. An apparatus comprising:

an electrode;

said electrode being made from a transparent grid and further comprising a phosphor and electrode layer; and a device for causing secondary emission of electrons from said electrode.

16. The apparatus as recited in claim 15, wherein said device for causing secondary emission of electrons from said electrode further comprises:

a device for causing an extraction of electrons from said electrode;

a device for causing said extracted electrons to excite a gas to produce positive ions; and said positive ions migrating to said electrode to thereby cause said secondary emission of electrons.

17. The apparatus as recited in claim 16, further comprising:

a material positioned to receive said electrons and thereby emit light in response thereto.

* * * * *